US005769210A

United States Patent [19]

Tsai

[11] Patent Number: 5,769,210

[45] Date of Patent: Jun. 23, 1998

[54] SCISSORS-TYPE KEY SWITCH

[75] Inventor: Ching-Cheng Tsai, Chi Lung, Taiwan

[73] Assignee: Chicony Electronics Co., Ltd., Taipei Hsien, Taiwan

[21] Appl. No.: 798,630

[22] Filed: Feb. 11, 1997

[51] Int. Cl.[6] ..... H01H 3/12

[52] U.S. Cl. ..... 200/344; 200/345

[58] Field of Search ..... 200/340, 341, 200/344, 345, 512, 515, 517, 520, 5 A

[56] References Cited

U.S. PATENT DOCUMENTS

| | | | |
|---|---|---|---|
| 4,433,225 | 2/1984 | Cowles | 200/340 |
| 5,278,371 | 1/1994 | Watanabe et al. | 200/344 |
| 5,278,372 | 1/1994 | Takagi et al. | 200/344 |
| 5,329,084 | 7/1994 | Watanabe et al. | 200/344 |
| 5,512,719 | 4/1996 | Okada et al. | 200/344 |
| 5,562,203 | 10/1996 | Mochizuki | 200/345 |

*Primary Examiner*—Khanh Dang
*Attorney, Agent, or Firm*—Morton J. Rosenberg; David I. Klein; Jun Y. Lee

[57] ABSTRACT

A scissors-type key switch comprising a key top, a scissors-type supporting bracket, a base member, an elastic actuator, a membrane switch, and a bottom plate is provided. The membrane switch, the elastic actuator, and the base are disposed above the bottom plate. The scissors-type supporting brackets are pivotally supported and received on the base by the pivotally engagement between the pin shaft of the supporting brackets and the connecting holes of the base. The key top is also pivotally connected to the scissors-type supporting brackets by the connecting slots of the key top and the pin shafts of the supporting bracket. This scissors-type key switch features a simplified structure resulted from reduced number of components and durable operation wherein the key top can readily move down and up without rolling thereof. The manufacturing cost is advantageously reduced while the throughput is considerably increased.

5 Claims, 4 Drawing Sheets

SCISSORS-TYPE KEY SWITCH

FIELD OF THE INVENTION

The present invention relates to a key switch, more particularly, to a scissors-type key switch for notebook computer. This scissors-type key switch features a simplified structure resulted from reduced number of components and durable operation wherein the key top can readily move down and up without rolling thereof.

DESCRIPTION OF PRIOR ART

As shown in FIG. 1, a conventional keyboard assembly used on notebook computer is shown. The conventional key switch 10*a* generally comprises a key top 11*a*, an elastic actuator 12*a*, a first supporting bracket 13*a*, a second supporting bracket 14*a*, a membrane switch 15*a*, and a basic plate 16*a*. The key top 11*a* is disposed atop of the first and second supporting brackets 13*a* and 14*a* which are disposed with cross to each other. The key top 11*a* can be moved downward as guided by the combination of the first and second supporting brackets 13*a*, 14*a*. When the key top 11*a* is depressed, the elastic actuator 12*a* disposed thereunder will actuate the membrane switch 15*a* such that a closed signal is sent when the switch 15*a* is closed, i.e. On. When the external force is removed, the key top 11*a* is bounced back and the switch 15*a* is resumed to open, Off position.

Nevertheless, since the first and second supporting bracket 13*a* and 14*a* are not symmetrically to each other and can not be replaced with each other. Consequently, the manufacturing cost is quite high since each of the brackets is made from an associated mold. On the other hand, if the operator is not quite concentrated, the first and second supporting bracket can be misused from each other. On the other hand, the configuration of the base plate is quite complex which is not good for production. Even those components are assembled to form a key switch for the notebook computer, the key top 11*a* is found to have a stable movement, easy to roll, and incomplete actuation.

In light of this, there is a need to improve the conventional key switch.

SUMMARY OF THE INVENTION

It is the object of this invention to provide a scissors-type key switch for notebook computer. This scissors-type key switch features a simplified structure resulted from reduced number of components and durable operation wherein the key top can readily move down and up without rolling thereof.

In order to achieve the object set forth, a scissors-type key switch comprising a key top, a scissors-type supporting bracket, a base member, an elastic actuator, a membrane switch, and a bottom plate is provided. The membrane switch, the elastic actuator, and the base are disposed above the bottom plate. The downward and upward movements of the key top is vertically guided by a pair of scissors-type supporting brackets. The supporting bracket has identically configuration which can be readily replaced with each other. Consequently, the manufacturing cost can be considerably reduced since only one mold is required. On the other hand, the throughput of the key switch can also be increased since the operator will not misuse the incorrect components. Furthermore, the bottom plate has a simple configuration which in turn benefits mass production.

According to another aspect of the present invention, the key top is further provided with a guiding ribs which serve as a guiding means to stable the key top during the downward movement. The key top further includes auxiliary ribs which may contact with the scissors-type supporting bracket when the key top is depressed. Consequently, the key top will not roll-off. In light of this, the key switch made according to the present invention provides a substantial actuation.

BRIEF DESCRIPTION OF THE DRAWINGS

In order that the present invention may more readily be understood the following description is given, merely by way of example with reference to the accompanying drawings, in which.

Brief Description of Numerals

| | | | |
|---|---|---|---|
| 10 | key top | | |
| 11 | positioning post | 12 | ventilating slot |
| 13 | auxiliary rib | 14 | guiding rib |
| 15 | connecting slot | | |
| 20 | scissors bracket | | |
| 21 | supporting arm | 22 | pin shaft |
| 23 | pin shaft | 24 | base plate |
| 25 | cutout | 26 | external teeth portion |
| 27 | internal teeth portion | | |
| 30 | base member | | |
| 31 | through hole | 32 | connecting socket |
| 33 | connecting hose | | |
| 40 | elastic actuator | | |
| 41 | basic portion | 42 | pressing portion |
| 43 | central hole | 44 | ventilating slot |
| 50 | membrane switch | | |
| 60 | bottom plate | | |
| 10a | key switch | 11a | keytop |
| 12a | elastic actuator | 13a | first supporting bracket |
| 14a | second supporting bracket | 15a | membrane switch |
| 16a | bottom plate | | |

DETAILED DESCRIPTION OF PREFERRED EMBODIMENT

Figure 1:
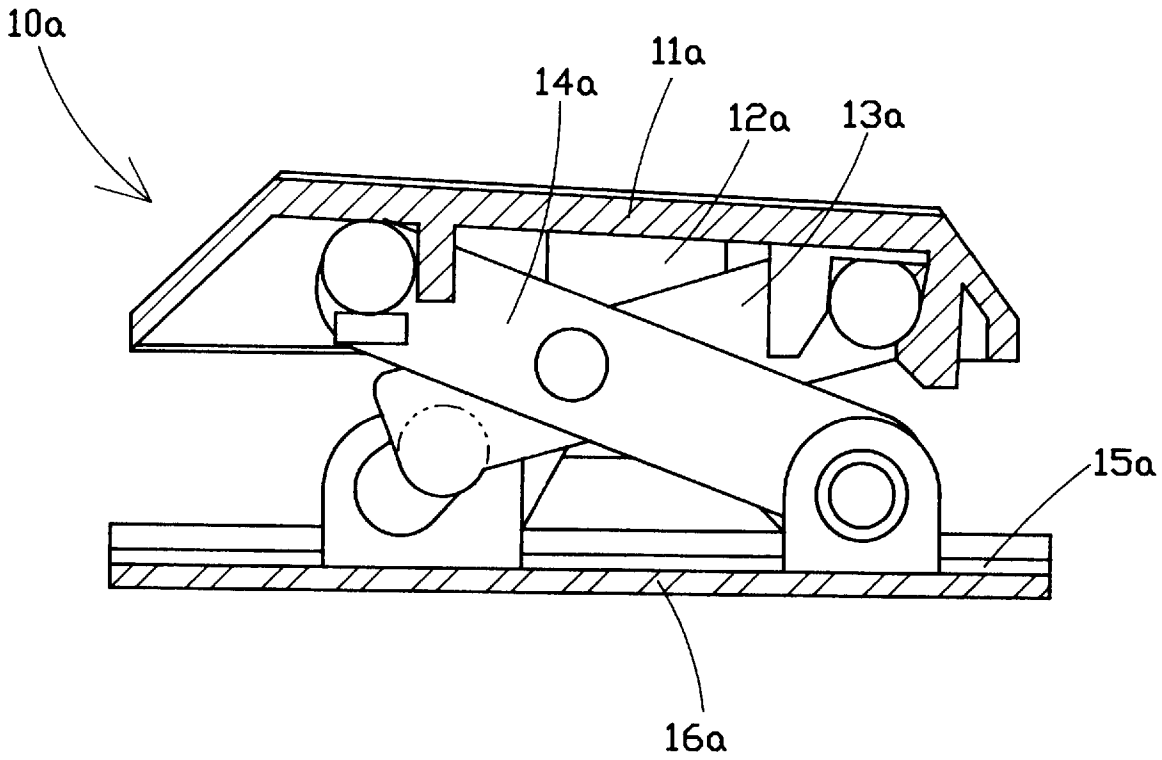
FIG. 1 (PRIOR ART)
FIG. 1 is a cross sectional view of a conventional key switch.
Figure 2:
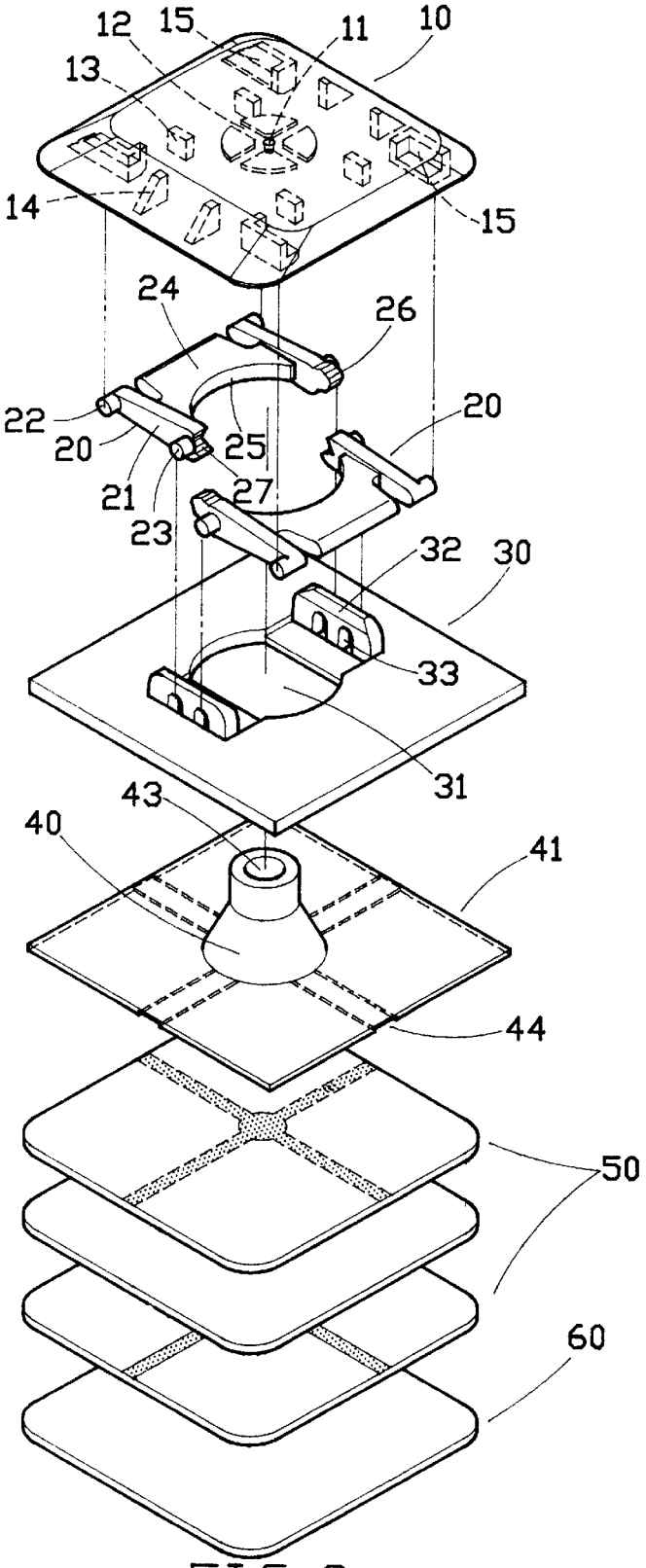
FIG. 2 is an exploded perspective view of the scissors key switch made according to the present invention.
Figure 4:
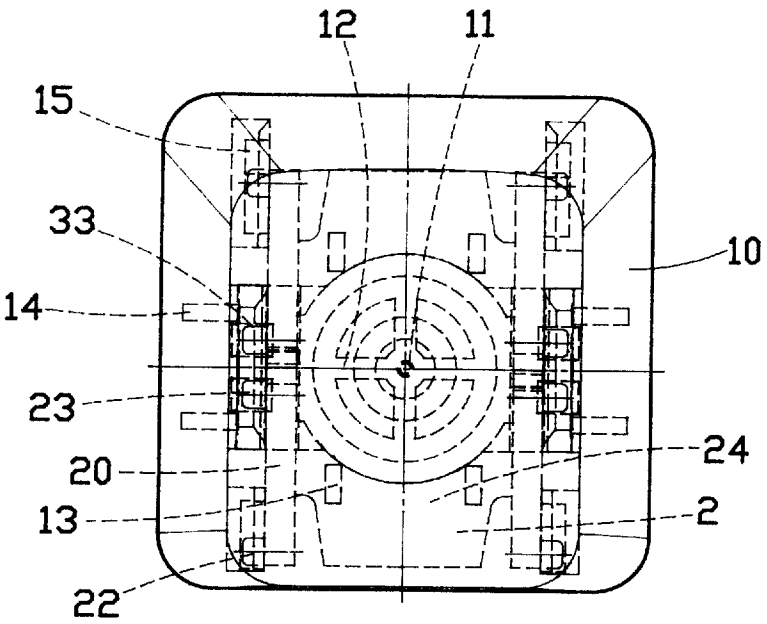
FIG. 4 is a top plan view of the key switch shown in FIG. 2.
Figure 3:
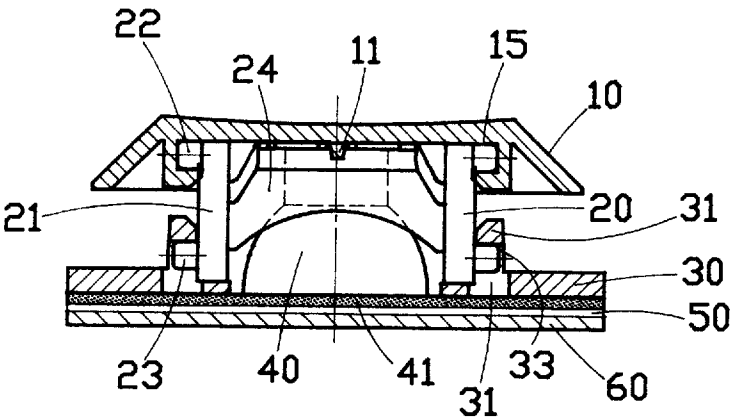
FIG. 3 is a cross sectional view of the key switch shown in FIG. 2.

Referring to FIGS. 2, 3, and 4, respectively showing the exploded perspective view, cross sectional view and top plan view of the scissors key switch of the present invention. The scissors-type key switch made according to the present invention generally comprises a key top 10, a scissors-type supporting bracket 20, a base member 30, an elastic actuator 40, a membrane switch 50, and a bottom plate 60.

The key top 10 has a square shape having an elastic positioning post 11. The outer peripheral of the positioning post 11 is provided with a ventilating slot 12. The ceiling of the key top 10 further includes four auxiliary ribs 13 and four guiding ribs 14. The key top 10 further includes four connecting slots 15 for connecting with the scissors-type supporting brackets 40.

The key top 10 can be well supported by a pair of scissors-type supporting brackets 20. Each of the supporting brackets 20 includes a pairs of supporting arms 21 disposed opposite to each other. Each of the supporting arm 21 further includes a pair of pin shafts 22, 23 at upper and lower end portions respectively. The supporting arms 21 are connected to each other by a base plate 24. The lower portion of the base plate 24 is provided with a circular cutout 25. One of the supporting arms 21 of the supporting bracket 20 is provided with an external teeth portion 26 at the lower portion and the other supporting arm 21 is provided with an internal teeth portion 27 corresponding to the external teeth portion 26. When those external and internal teeth portion 26, 27 are meshed together, the scissors-type supporting brackets 20 can be moved in an interactive manner.

The supporting brackets 20 can be well supported and installed on the base. The base 30 is provided with a through hole 31 for passing through thereof the elastic actuator 40 in the position corresponding to the key top 10 and the supporting bracket 20. Both sides of the through hole 31 are provided with a connecting socket 32 respectively. Each of the connecting sockets 32 is provided with a connecting hole 33 for pivotally receiving the pin shaft 23 of the supporting arm 21 of the supporting bracket 20.

Figure 5:
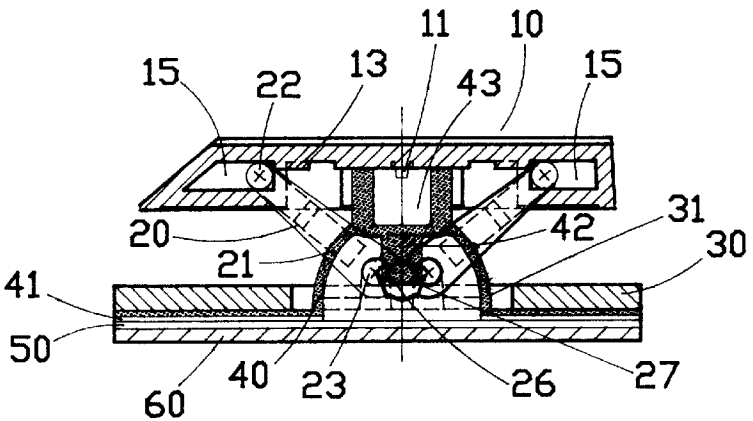
FIG. 5 is a schematic illustration of the key switch shown in FIG. 2 wherein the key top is positioned at the normal position.

The elastic actuator 40 is disposed within the through hole 31 of the base 30. Each of the key top 10 is provided with an elastic actuator 40 having a shape of dome. The basic portion 41 of elastic actuator 40 is disposed right under the base 30. The elastic actuator 40 can be disposed individually or can be formed in an array. The elastic actuator 40 is provided with a pressing portion 42 internally, as shown in FIG. 5. The elastic actuator 40 is provided with a central hole 43 in the top and a ventilating slot 44 at the bottom.

The membrane switch 50 is disposed under the elastic actuator 40 and is supported by a bottom plate 60. By this arrangement, all these components can be well supported by the bottom plate 60.

In assembling, the membrane switch 50, the basic portion 41 of he elastic actuator 40, and the base 30 are disposed and assembled onto the bottom plate 60 in order such that the elastic actuator 40 is projected over the base 30 through hole 31 of the base 30. Afterward, the pin shafts 23 of the supporting arm 21 of the scissors-type supporting bracket 20 are pivotally received and retained within the corresponding connecting holes 33 of the connecting socket 32 of the base 30. In light of this, the scissors-type supporting brackets 20 are pivotally attached to the base 30. On the other hand, the lower portion of the supporting brackets 20 are interactively connected by the external and external teeth portion 26 and 27. Finally, the key top 10 is disposed on the supporting brackets 20 such that the pin shafts 22 of the supporting arms 21 of the scissors-type supporting brackets 20 are pivotally received and retained within the connecting slots 15 of the key top 10. By this arrangement, the key top 10 can be well supported by the scissors-type supporting bracket 20 for vertical downward and upward movement. On the other hand, the elastic positioning post 11 of the key top 10 is positioned within the central hole 43 of the elastic actuator 40. By this arrangement, when the key top 10 is depressed, the pressing portion 42 of the elastic actuator 40 will accurately press against the membrane switch 50 to ensure a signal generation.

Figure 6:
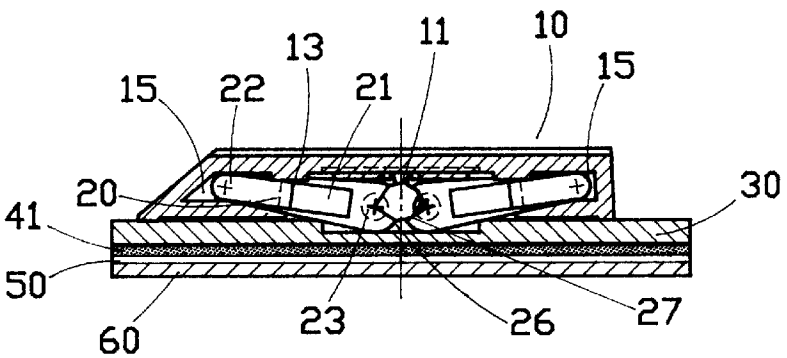
FIG. 6 is still a schematic illustration of the key switch shown in FIG. 2 wherein the key top is positioned at the actuated position.

Referring to FIGS. 5 and 6, two schematic illustrations are respectively shown. When the key top 10 is depressed by the finger of a user, the key top 10 may readily and vertically move downward as guided by the scissors-type supporting bracket 20 such that the pressing portion 42 of the elastic actuator 40 will actuate the membrane switch 50 to close, as shown in FIG. 6. As a result, a signal will be generated. When the depressing force is released, the key top 10 may readily be bounced back by the potential force of the elastic actuator 40 as guided vertically by the scissors-type supporting brackets 20. When the pressing portion 42 of the elastic actuator 40 is removed from the membrane switch 50, the switch 50 is resumed to open status, as shown in FIG. 5.

By the provision of the present invention, the key top 10 is vertically guided by the scissors-type supporting brackets 20 during the downward and upward movement. Furthermore, those two supporting bracket 20 are identically to each other such that it can be replaced with each other. In light of this, the manufacturing cost can be considerably reduced since only one mold is required for making the supporting bracket 20. Besides, since those supporting brackets 20 are identically to each other, there is no possibility of misusing incorrect supporting bracket 20 during the assembling. Consequently, the performance can be increased and the throughput can also be reduced.

As described above, the key top 10 is provided with four guiding ribs 14 which can be contacted with the outer portion of the connecting socket 32, this may also enhance the stability of the key top 10 during the downward and upward movement. On the other hand, when the key top 10 is moved downward, the key top 10 may contact with the base plate 24 of the supporting bracket 20, by this arrangement, the key top 10 will not slide thereof and a more substantial actuation is ensured.

From the forgoing description, the problems encountered by the conventional key switch can be readily solved by the provision of the scissors-type key switch which features a simplified structure resulted from reduced number of components and durable operation wherein the key top can readily move down and up without rolling thereof.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A scissors-type key switch comprising, a key top having four connecting slots thereof;

a pair of scissors-type supporting brackets, each of said supporting brackets including a pairs of supporting arms disposed opposite to each other, each of said supporting arm further including a pair of pin shafts at upper and lower end portions respectively, said supporting arms being connected to each other by a base plate, the lower portion of said base plate being provided with a circular cutout, one of said supporting arms being provided with an external teeth portion at the lower portion and the other supporting arm being provided with an internal teeth portion corresponding to the external teeth portion, wherein when said external and internal teeth portion are meshed together, said scissors-type supporting brackets can be moved in an interactive manner;

a base for receiving and supporting said supporting brackets, said base being provided with a through hole for passing through thereof the elastic actuator in the position corresponding to said key top, both sides of said through hole being provided with a connecting socket respectively, each of said connecting sockets being provided with a connecting hole for pivotally receiving said pin shaft of said supporting arm of said supporting bracket;

an elastic actuator being disposed within said through hole of said base;

a membrane switch being disposed under said elastic actuator; and a bottom plate being disposed under said membrane switch;

wherein said membrane switch, said elastic actuator and said base are disposed above said bottom plate and said scissors-type supporting brackets are well supported and received within said base by the pivotally engagement between said pin shafts and said connecting holes of said connecting sockets of said base, said key top is pivotally connected with said scissors-type supporting brackets by the connecting slots of said key top and said pin shafts of said scissors-type supporting bracket.

2. A scissors-type key switch as recited in claim 1, wherein said key top further including auxiliary ribs thereof.

3. A scissors-type key switch as recited in claim 1, wherein said key top further including guiding ribs thereof.

4. A scissors-type key switch as recited in claim 1, wherein said key top further including an elastic positioning post to be positioned within a central hole in the top of said elastic actuator, said elastic actuator being provided with ventilating slot.

5. A scissors-type key switch as recited in claim 1, wherein said elastic actuator being provided with a pressing portion and a ventilating slot being disposed at the basic portion of said elastic actuator.

* * * * *